United States Patent [19]

Muck et al.

[11] Patent Number: 4,609,207

[45] Date of Patent: Sep. 2, 1986

[54] METHOD OF TESTING A SECURITY AND A SECURITY FOR CARRYING OUT THIS METHOD

[75] Inventors: Hajo Muck, Dachau; Wolfgang Becker, Neubiberg, both of Fed. Rep. of Germany

[73] Assignee: GAO Gesellschaft fur Automation und Organisation mbH, Munich, Fed. Rep. of Germany

[21] Appl. No.: 690,375

[22] Filed: Jan. 9, 1985

Related U.S. Application Data

[63] Continuation of Ser. No. 364,632, Apr. 2, 1982, abandoned, which is a continuation of Ser. No. 161,094, Jun. 19, 1980, abandoned.

[30] Foreign Application Priority Data

Jun. 22, 1979 [DE] Fed. Rep. of Germany ..... 2925273

[51] Int. Cl.[4] ..... B42D 15/00

[52] U.S. Cl. ..... 283/70; 283/74; 283/82; 283/83; 283/85; 283/91; 360/114; 235/493

[58] Field of Search ..... 283/70, 74, 82, 83, 283/85, 91, 904; 235/492, 493; 306/2, 114

[56] References Cited

U.S. PATENT DOCUMENTS

| | | | |
|---|---|---|---|
| 964,014 | 7/1910 | Gernaert . | |
| 2,968,799 | 1/1961 | Smith | 360/114 X |
| 3,173,291 | 3/1965 | Simjian | 283/58 X |
| 3,422,269 | 1/1969 | Di Chen | 360/114 |
| 3,471,172 | 10/1969 | Bayha . | |
| 3,652,862 | 3/1972 | Bayha | 250/362 |
| 3,783,249 | 1/1974 | Wiegand | 235/493 X |
| 3,873,813 | 3/1975 | Lahr | 235/380 |
| 4,066,280 | 1/1978 | La Capria | 283/91 |
| 4,151,405 | 4/1979 | Peterson | 235/493 X |
| 4,186,943 | 2/1980 | Lee | 283/91 |
| 4,203,544 | 5/1980 | Guilgue | 235/493 X |
| 4,253,017 | 2/1981 | Whitehead | 283/82 X |

FOREIGN PATENT DOCUMENTS

| | | |
|---|---|---|
| 964014 | 7/1910 | Belgium . |
| 2215628 | 9/1973 | Fed. Rep. of Germany . |
| 1774290 | 4/1976 | Fed. Rep. of Germany . |
| 0795286 | 3/1936 | France . |
| 1193511 | 6/1970 | United Kingdom . |
| 1357489 | 6/1974 | United Kingdom . |
| 1488660 | 10/1977 | United Kingdom . |

*Primary Examiner*—Robert L. Spruill
*Assistant Examiner*—Taylor J. Ross
*Attorney, Agent, or Firm*—Neuman, Williams, Anderson & Olson

[57] ABSTRACT

A method of testing a security having a mechanically testable identifying mark, for example a security thread, which has a physical property, for example electric conductivity, which can be measured without contact by means of a first field, for example, an electric field. The physical property can be reproducibly influenced by the effect of a second field, for example an electromagnetic field. If this influence takes place periodically, a signal is produced as a measured variable modulated according to the mutual effect of the two fields.

14 Claims, 3 Drawing Figures

METHOD OF TESTING A SECURITY AND A SECURITY FOR CARRYING OUT THIS METHOD

Figure 2:
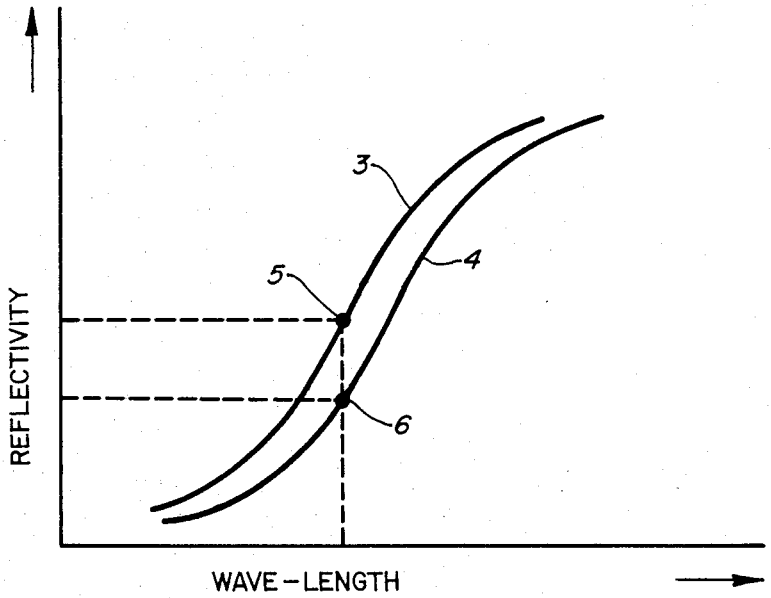

This application is a continuation of application Ser. No. 364,632 filed Apr. 2, 1982 abandoned, which is a continuation of application Ser. No. 161,094, filed on June 19, 1980, abandoned, which is hereby incorporated by reference.

The invention relates to a method of testing a security having a mechanically testable identifying mark, whereby the effect that the mark causes a second field to have on a first field of a different kind, is used to judge authenticity, as well as a security for carrying out this method.

For protecting identification cards, documents, securities and bank-notes, it is already known to equip them with identifying marks, e.g. security threads, which allow for easy visual or automatic verification of their authenticity. Thus, the U.S. Pat. No. 964,014 already discloses the incorporation of thin metal sheets in the form of strips into bank-notes, which strips exhibit a certain color, impression or particular shape. As it is only possible to incorporate such a sheet into the paper during the manufacture of the paper, which requires considerable technical resources, forgeries are accordingly difficult to make. However, in the case of automatic verification of authenticity, only specific properties of the incorporated security strip, such as its electrical conductivity, are detected; it is comparatively simple to imitate such specific properties, e.g. by providing an appropriate surface print. The value of conventional identifying marks as conceived for visual testing is therefore greatly limited for automatic testing methods.

More recently, security threads with special physical properties have thus won through, the existence of which can be determined visually and/or manually, but the authenticity of which can only be tested mechanically. The German Offenlegungsschrift No. 20 01 944, for example, discloses bank-hotes with magnetic and/or electrically conductive layers which, arranged in a certain configuration, are coded to suit automatic machines. The dimensions, conductivity, radiation permeability and the arrangement of the layers can be determined in the testing apparatus. The German Auslegeschrift No. 22 15 628 discloses a bank-note with a metal security thread which includes certain coded information specific to the bank-note. The information may be present either in the form of punch holes or as a magnetic track. Finally, British Pat. No. 13 57 489 discloses a bank-note with a security thread made of ferromagnetic material, characterized by the fact that the thread has a high degree of coercive force so that any magnetic information applied cannot be erased or altered so easily by a forger.

The use of a security thread as an identifying mark has certain advantages which explain its widespread use. The thread is located in the paper and can therefore only be incorporated during the manufacture of the paper or card; the corresponding technology and expensive apparatus necessary are not normally at the disposal of a forger. The presence of the thread can also be easily checked visually, without any technical aids. If the thread also exhibits certain mechanically detectable properties, it lends itself to automatic testing as well.

These advantages, however, are paired with a number of disadvantages which are particularly detrimental in the case of the ever-increasing method of automatic authenticity testing, because the latter does not detect the entire impression of the security thread or security.

The usual physical properties used in this connection are, for example, electrical conductivity, magnetism, fluorescence, etc. As the visual appearance of the security is not important in the case of exclusively mechanical testing, a forger can imitate these properties relatively easily, for example by imitating the electrical conductivity of the security thread by means of a pencil stroke on the surface of the security, imitating certain magnetic properties by gluing on a strip of recording tape, or imitating certain fluorescent behavior by painting on commercial fluorescent substances.

A forger further has the possibility of gluing two sheets of paper together, for example, and thereby reducing the forging difficulties to the imitation of the security thread itself. In some cases, it may also suffice to imitate the specific properties of the security thread on the surface of the security. The physical properties of the security thread measured by the testing apparatus can be easily detected by a forger in many cases, as corresponding sensors are generally readily available.

The object of the invention is therefore to provide a method, suitable for automatic machines, of testing a security having identifying marks, which uses as a criterion for authenticity certain properties of the marks which are much more difficult for a forger to analyze and imitate effectively.

A further object is to provide a security for carrying out the testing method.

This object is solved according to the invention by the means stated in the characterizing part of the main claim; developments of the invention can be found in the subclaims.

A security for carrying out the method according to the invention is equipped with an identifying mark exhibiting a certain physical property which alters a chronologically periodic field in accordance with the magnitude of this physical property, whereby the magnitude of the physical property is in turn affected by a second field, which can also be altered in time, but has a different quality than the first field.

In order to test the authenticity of the security, the identifying mark is put into the first field, which is influenced by the mark and simultaneously causes the second field, which influences the magnitude of the certain physical property of the mark, to have a time controlled effect on the identifying mark.

The first field is thus modulated with the second field due to the effect of the identifying mark. Certain properties of this modulation, such as the sideband component frequencies it produces and the modulation percentage, are measured and used as criteria for authenticity. A further criterion for authenticity which may be used is the cutoff frequency at which the modulability of the identifying mark ends. If the measured values correspond within certain tolerance limits to the known expected values for an authentic security, the security is recognized as authentic; otherwise it is forged.

It is obvious that an identifying mark with the above-mentioned "hidden" properties is much more difficult to discover, analyze and imitate than the known "directly detectable" electrically conductive or magnetic marks especially when the possible modulation percentage is very small. By using phase-sensitive amplifiers, relative changes of $10^{-6}$ can be detected with certainty in the test signal. It is therefore also possible even in the case of very little modulability to detect these changes along with the basic property of the mark. Detectability is also made more difficult by the fact that the identifying agent can be located not only in a security thread, but also in the paper or printing ink.

It is not only significantly more difficult to detect the critical properties, this is also the case for the analysis of the identifying mark. This is mainly due to the fact that the values that are used as criteria for authenticity and mark the modulation, are dependent on the frequency. As a forger does not know which frequencies are being tested at in the automatic machine, he is forced to detect these values at all frequencies. If he succeeds at this, he is still forced to adapt his imitation to these measured values at all frequencies; this amounts in practice to a total forgery of the identifying mark.

But a total forgery is made very much more difficult because the properties used in the testing method according to the invention are not simply specific to the material, they critically depend in particular on production technology. This becomes apparent in the case of a photoconductive security thread, for example, the quantum yield and decay behavior of which are very greatly affected by doping, temperature treatment, size of grain and so on.

Figure 1:
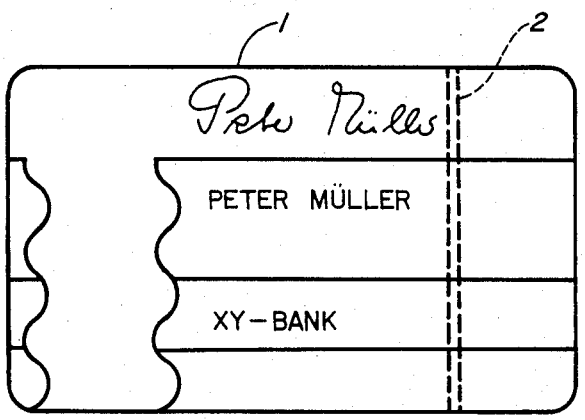
Figure 3:
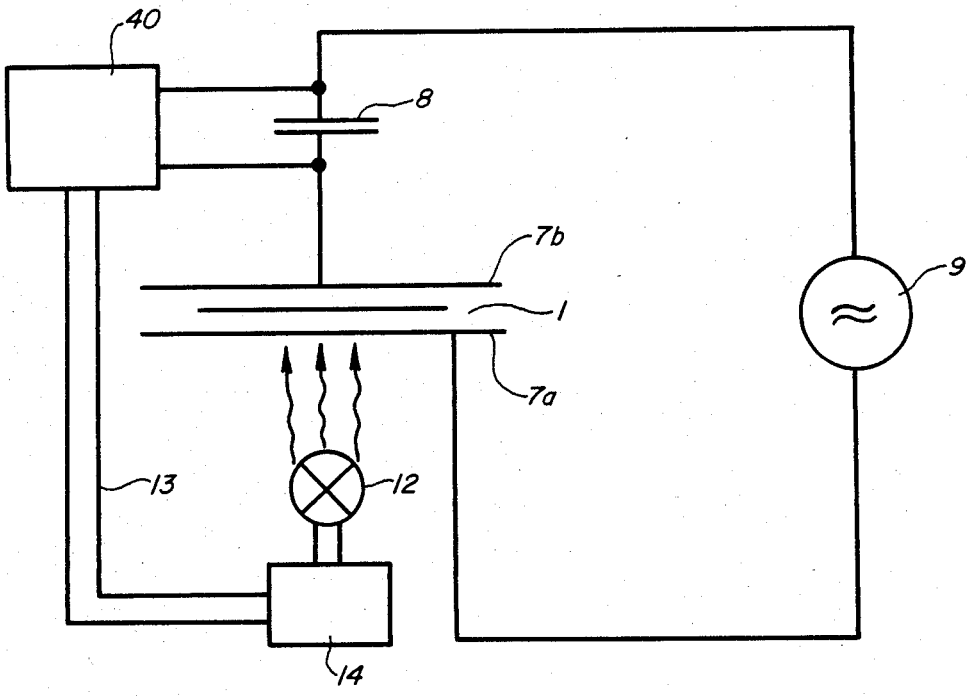

In the following, the invention shall be described in more detail in connection with the drawings and three examples of the production of an identifying mark according to the invention. The figures show:

FIG. 1 a top view of an identification card with embedded security thread,

FIG. 2 a graphic representation of two positions of the break of the absorption curve of an identifying agent as in Example 3, and FIG. 3 a diagram of a device for carrying out the testing method according to the invention.

FIG. 1 shows an identification card with a paper inlay in two transparent cover films; the identifying mark is present in the form of a security thread inside the paper inlay. The security thread consists of a film, which is preferably coated with a material exhibiting the properties of the mark according to the invention. In the following, three examples of different designs of this type of security thread are given.

EXAMPLE 1

A security thread was incorporated into the median plane of a security known as such, having a weight per unit area of 80 g/m$^2$, during formation of the sheet. For this purpose a 20 mm thick PVC film was coated with copper-doped cadmium sulfide (cdSiCu) of the Riedel de Haen Company (catalog no. 54040). The finely ground CdSiCu powder was first mixed with silicone resin (e.g. the silicone resin solution RE of the Wacker Chemie Company), and spread onto the film with a doctor with a layer thickness of 5 $\mu$m. Then the film was cut into threads having a width of 0.4 mm.

The security thread produced in this way had a dark conductivity of approximately $10^{-9}\ \Omega^{-1}\ cm^{-1}$; when illuminated by a 100 W bulb, conductivity rose to approximately $10^{-6}\ \Omega^{-1}\ cm^{-1}$.

Further experiments with cadmium sulfide doped with copper at differing degrees yielded differing light-/dark values which could always be detected and evaluated unambiguously according to measuring technology. Deviations were dependent upon doping and production technology.

It must be pointed out that it is advantageous to use substances in practical application which are not commercially available, at least not prepared in this way. In practice, one should thus produce the above-mention Cu-doped Cds oneself, and make sure that its photoconductive properties deviate somewhat from those of commercial products. This is feasible because commercial products are developed so as to achieve an optimal quantum yield, whereas this optimization is unimportant for the identifying mark according to the invention.

EXAMPLE 2

A security thread consisting of a transparent PVC film with a width of 0.4 mm and a thickness of 25 $\mu$m was embedded in bank-note paper having a weight per unit area of 80 g/m$^2$, during manufacture of the paper. The security thread was coated with p-type germanium. The amount of doping was approximately $10^{-15}\ cm^{-3}$. The coating was applied to an appropriate film by means of electron beam sputtering, and the film then cut to size. Of course, coating can also be carried out with other methods that are part of prior art, for example by thermal vaporization. An electrical resistance increase of about 8% was produced on the security thread when a magnetic field with a strength of about 0.6 Tesla was applied perpendicular to the path of the electric current. This change in electrical conductivity is based on a deflection of the charge carriers bearing the current in the semi-conductor substrate, caused by the Lorentz force acting upon them in the magnetic field. This prolongs the path of the charge carriers, thus causing a change in resistance.

EXAMPLE 3

A security thread was embedded so as to be freely accessible optically between the cover film and the paper of an identification card comprising an inlay of printed paper and two transparent cover films.

The security thread consisted of a transparent PVC film with a width of 0.4 mm and a thickness of 25 $\mu$m. The film was coated with polycrystalline cadmium sulfide. The coating was applied by means of electron beam sputtering. Of course, other methods in the art may also be used to apply the coating. The security thread was yellow. The reflection of the security thread at room temperature at the break of the absorption curve (at approximately 515 nm) shifted when an electric field of about $3.10^4$ V/m acted upon the semi-conductor material. The change in reflection $\Delta R/R$ amounted to about 1% at this place in the spectrum.

FIG. 2 shows this situation schematically. Curve 3 represents the break of the absorption curve of the cadmium sulfide without an electric field, and curve 4 represents the break of the absorption curve when an electric field is applied. Reflectivity R decreases from point 5 to point 6 at the wavelength used for measurement. This wavelength can be localized so as to be accordingly precise, by means of filters.

The change in reflectivity is not limited to the break in the absorption curve. Such changes can also be observed at certain other wavelengths in the reflection spectrum. However, a particularly marked effect is produced at the break in the absorption curve.

The testing method according to the invention shall now be described in a special embodiment with reference to FIG. 3, and for an identification card with a photoconductive security thread as in Example 1.

The identification card is introduced, by a transporting device not shown, into condenser 7, which is formed by transparent electrode 7*a* and backplate electrode 7*b*. On the outlet side of condenser 7 condenser 8 is connected as a voltage divider, the voltage of which is controlled by lock-in amplifier 10. An electric alternating voltage, for example of 60 Volt and 20 kHz, is applied to the condenser chain by generator 9, which also subjects the photoconductive security thread to a corresponding electric alternating field. At the same time light hits the security thread through photodiode 12 set, for example, at 20 Hz.

This alters the conductivity of the security thread in time to the illumination. When the thread located in condenser 7 changes its conductivity, the voltage division in the condenser chain also changes, i.e. the voltage changes at condenser 8. This change takes place in time with the illumination and can therefore be measured at lock-in amplifier 10 up to relative changes of about $10^{-6}$; for this purpose the latter receives its phase-locked reference signal 13 from drive 14 of the photodiode.

Using the method described above, the percentage modulation is first measured at a certain illumination frequency.

But the same arrangement can also be used to determine the two other values that may be used as criteria for authenticity.

In order to determine the cutoff frequencies of the identifying agent, the illumination pulse is increased up to the point where the percentage modulation read off the lock-in amplifier decays to zero; now the photoconductor can no longer follow the change in illumination fast enough. The corresponding illumination frequency is held as the cutoff frequency, and serves as a criterion for authenticity in the above sense when compared with the values of a genuine security thread.

The alternating voltage applied to condenser 8 can, however, also be described, analogously to radio engineering, as a generator alternating voltage amplitude-modulated with the light pulse.

When the generator works with frequency $F_G$ and the photodiode is chopped with frequency $F_F$, the voltage at condenser 8 also exhibits sideband component frequencies $F_G+F_F$ and $F_G-F_F$. When the lock-in amplifier is accordingly triggered, i.e. when it is fed a corresponding reference signal, one can also check whether the corresponding sideband component frequencies are present or not. The reference signal can be produced, for example, with a square-wave generator which can be tuned as to frequency.

Of course, the above-mentioned criteria for authenticity can also be used in combination.

The testing device must naturally be accordingly modified for identifying marks as in Examples 2 and 3 and others according to the invention.

The examples explained above are intended merely to illustrate the invention; the latter is not limited by such embodiments. The identifying agent may be provided not only in a security thread, but also added to the paper or ink, in particular to screen printing inks.

What is claimed is:

1. A method for determining the authenticity of a security paper having an authenticity portion, said authenticity portion being such as to allow measurement of a particular physical characteristic thereof by means of the application of a first type of field and also being such that said particular physical characteristic is itself modulated in a periodical manner by simultaneously applying a second type of field different from the first type of field, the intensity of said second type of field changing periodically; said method comprising the steps of applying the second type of field while modulating the intensity of said second type of field at a predetermined frequency to produce a corresponding modulation of said particular physical characteristic at said predetermined frequency, and measuring said particular physical characteristic indirectly as the change of the field intensity of the first type of field to determine modulations in said physical characteristic at said predetermined frequency produced by the second type of field and to thereby determine the authenticity of the security paper.

2. Apparatus for determining the authenticity of a security paper having an authenticity portion, said authenticity portion being such as to allow measurement of a particular physical characteristic thereof by means of the application of a first type of field and also being such that said particular physical characteristic is itself modulated in a periodical manner by simultaneously applying a second type of field different from the first type of field, the intensity of said second type of field changing periodically; said apparatus comprising first means for applying the second type of field to said security paper while modulating the intensity of said second type of field at a predetermined frequency to produce a corresponding modulation of said particular physical characteristic of said authenticity portion thereof, and second means including second field applying means for applying said first type of field to said authenticity portion, and means for measuring said particular physical characteristic of said authenticity portion indirectly as the modulation of the field intensity of the first type of field and to determine whether modulation at said predetermined frequency in said particular physical characteristic produced by the second type of field meets a predetermined standard and to thereby determine the authenticity of the security paper.

3. The apparatus of claim 2 in which said measuring means includes means for responding to the modulation of said physical characteristic at said predetermined frequency produced by said second type of field.

4. A security paper having an authenticity portion and being especially adapted to be tested for authenticity through the simultaneous application of first and second types of fields to said authenticity portion; said authenticity portion having a particular physical characteristic which is in a certain initial condition prior to application of said fields, which is modulated in a certain periodical manner and at a predetermined frequency, through the application of said second type of field while modulating the intensity of said second type of field at said predetermined frequency and which is such as to then produce a certain measurable change in field intensity of said simultaneously applied first type of field at said predetermined frequency; the authenticity of said paper being verifiable by the production of said certain measurable change in field intensity of said first type of field while applying said second type of field with the intensity thereof being modulated at said predetermined frequency to modulate said physical characteristic in a periodical manner; said particular physical characteristic being such as to be returned to said initial condition after discontinuing the simultaneous application of said first and second types of fields.

5. A security paper according to claim 4, in which said authenticity portion comprises a material having a certain electrical conductivity measurable by application of the first type of field with said electrical conductivity being changed under the influence of the second type of field in the form of optical illumination according to the intensity of the radiant energy.

6. A security paper according to claim 5 in which said authenticity portion comprises copper-doped cadmium sulfide.

7. A security paper according to claim 4, in which said authenticity portion comprises a material having a certain electrical conductivity measurable by application of the first type of field and changed under the influence of the second type of field in the form of a magnetic field according to the strength of the magnetic field.

8. A security paper according to claim 7 in which said authenticity portion comprises p-conductive germanium.

9. A security paper according to claim 4 in which said authenticity portion comprises a material having a reflectivity with respect to the first type of field in the form of electromagnetic energy with said reflectivity being changed under the influence of the second type of field in the form of an electrical field according to the intensity thereof.

10. A security paper according to claim 9 in which said authenticity portion comprises cadmium sulfide.

11. A security paper according to claim 5, 19, 20, 21, 22, 23 or 34 in which the authenticity portion includes a security thread.

12. A security paper according to claim 5, 6, 7, 8, 9, 10 or 4 in which said authenticity portion is contained in paper pulp.

13. A security paper according to claim 5, 6, 7, 8, 9, 10 or 4 in which said authenticity portion is included in a printing ink.

14. A security paper according to claim 13 in which said ink is such as to be applied by screen printing.

* * * * *